United States Patent [19]

Markle

[11] Patent Number: 5,069,343

[45] Date of Patent: Dec. 3, 1991

[54] STACKABLE RECYCLING STORAGE BIN APPARATUS

[76] Inventor: Jerry A. Markle, 2218 Farnsworth Rd., Lapeer, Mich. 48446

[21] Appl. No.: 619,389

[22] Filed: Nov. 29, 1990

[51] Int. Cl.[5] ..... B65D 17/34

[52] U.S. Cl. ..... 206/508; 220/908; 220/DIG. 13; 220/662

[58] Field of Search ..... 206/208, 511; 220/908, 220/DIG. 13, 334, 662

[56] References Cited

U.S. PATENT DOCUMENTS

| | | | |
|---|---|---|---|
| 3,419,184 | 12/1968 | Asenbauer | 206/508 |
| 4,307,835 | 12/1981 | Roccaforte | 206/508 |
| 4,450,960 | 5/1984 | Johnson | 206/508 |
| 4,747,510 | 5/1988 | Mack | 206/508 |
| 4,752,007 | 6/1988 | Rossi et al. | 206/508 |

*Primary Examiner*—Joseph Man-Fu Moy
*Attorney, Agent, or Firm*—Leon Gilden

[57] ABSTRACT

An apparatus is provided wherein an organization includes a lower container of a trapezoidal cross-sectional configuration accommodating a lid defined by a further trapezoidal cross-sectional configuration, wherein the lid is complementarily received upon the container and includes a pivoted entrance door, as well as a handle mounted on the lid receivable within a recessed cavity to permit vertical stacking of containers and lids. Each lid includes plural pairs of "L" shaped brackets to align and position a container thereon. A modification of the invention includes a disposable intermediate lid plate positioned between the lid and the container to receive disposed components of a lesser volume to minimize cleaning and maintenance of the container during use.

5 Claims, 4 Drawing Sheets

PRIOR ART

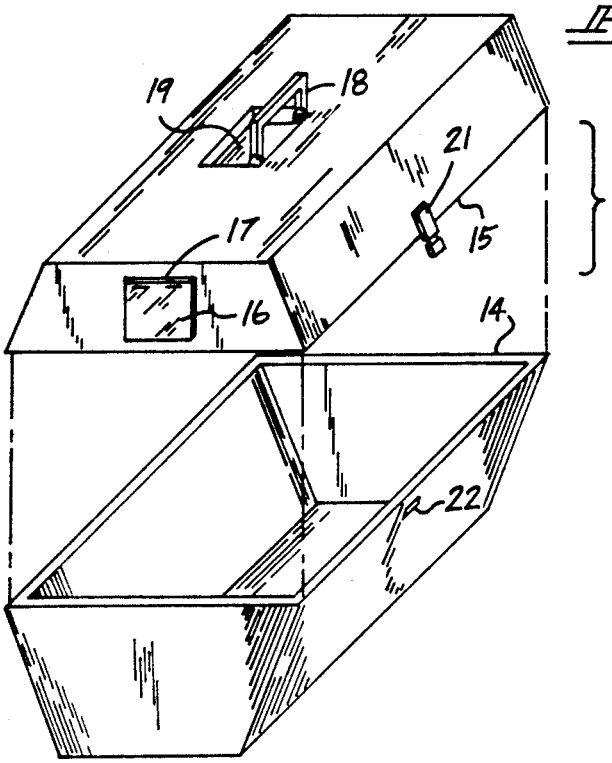
FIG 7
FIG 8
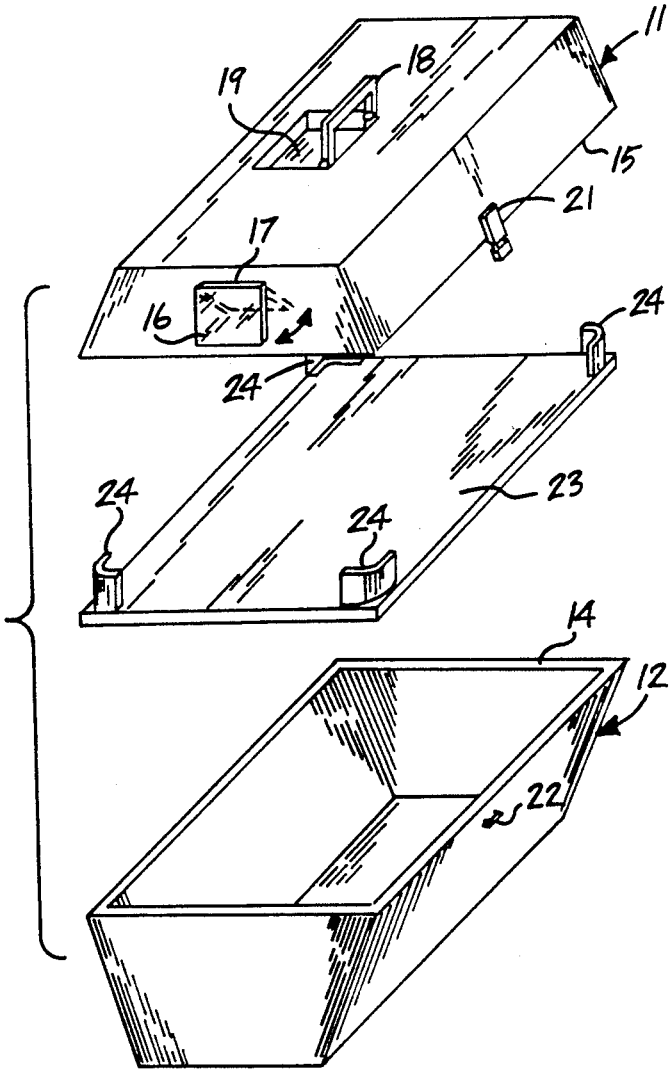

STACKABLE RECYCLING STORAGE BIN APPARATUS

BACKGROUND OF THE INVENTION

1. Field of the Invention

The field of invention relates to storage bins, and more particularly pertains to a new and improved stackable recycling storage bin apparatus wherein the same provides for vertical stacking of the storage bins minimizing required floor space in use.

2. Description of the Prior Art

Storage bins of various types have been provided in the prior art to receive components therewithin for recycling or disposal. Such organizations are exemplified in U.S. Pat. No. 4,821,903 to Hayes wherein a container includes a series of bins with a single lid overlying the bins.

U.S. Pat. No. 4,801,034 to Sandomeno sets forth a container wherein a plurality of bins within the container includes a removable receptacle for removal of the components contained within each receptacle relative to the bin.

U.S. Pat. No. 4,775,066 to Keepler provides a compartmentalized in-ground receptacle.

U.S. Pat. No. 4,874,111 to Heller sets forth a multicompartmented refuse container for receiving liners therewithin.

U.S. Pat. No. 3,893,615 to Johnson sets forth a multicompartmented refuse container mounted within a single framework.

As such, it may be appreciated that there continues to be a need for a new and improved stackable recycling storage bin apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of storage bin apparatus now present in the prior art, the present invention provides a stackable recycling storage bin apparatus wherein the same permits convenience of vertical positioning of the organization in use. As such, the general purpose of the present invention, which will be described subsequently in greater detail, is to provide a new and improved stackable recycling storage bin apparatus which has all the advantages of the prior art storage bin apparatus and none of the disadvantages.

To attain this, the present invention provides an apparatus wherein an organization includes a lower container of a trapezoidal cross-sectional configuration accommodating a lid defined by a further trapzoidal cross-sectional configuration, wherein the lid is complementarily received upon the container and includes a pivoted entrance door, as well as a handle mounted on the lid receivable within a recessed cavity to permit vertical stacking of containers and lids. Each lid includes plural pairs of "L" shaped brackets to align and position a container thereon. A modificiation of the invention includes, a disposable intermediate lid plate positioned between the lid and the container to receive disposed components of a lesser volume to minimize cleaning and maintenance of the container during use.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stackable recycling storage bin apparatus which has all the advantages of the prior art storage bin apparatus and none of the disadvantages.

It is another object of the present invention to provide a new and improved stackable recycling storage bin apparatus which may be easily and efficiently manufactured and marketed.

It is a further object of the present invention to provide a new and improved stackable recycling storage bin apparatus which is of a durable and reliable construction.

An even further object of the present invention is to provide a new and improved stackable recycling storage bin apparatus which is susceptible of a low cost of manufacture with regard to both materials and labor, and which accordingly is then susceptible of low prices of sale to the consuming public, thereby making such stackable recycling storage bin apparatus economically available to the buying public.

Still yet another object of the present invention is to provide a new and improved stackable recycling storage bin apparatus which provides in the apparatuses and methods of the prior art some of the advantages thereof, while simultaneously overcoming some of the disadvantages normally associated therewith.

Still another object of the present invention is to provide a new and improved stackable recycling storage bin apparatus wherein the same provides for the convenience of stacking and maintenance of the various containers utilized while minimizing horizontal floor space required.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 7 is an isometric illustration of the lid and container in a separated orientation.

FIG. 8 is an isometric illustration of the storage bin apparatus utilizing an intermediate lid plate member.

DESCRIPTION OF THE PREFERRED EMBODIMENT

Figure 1:
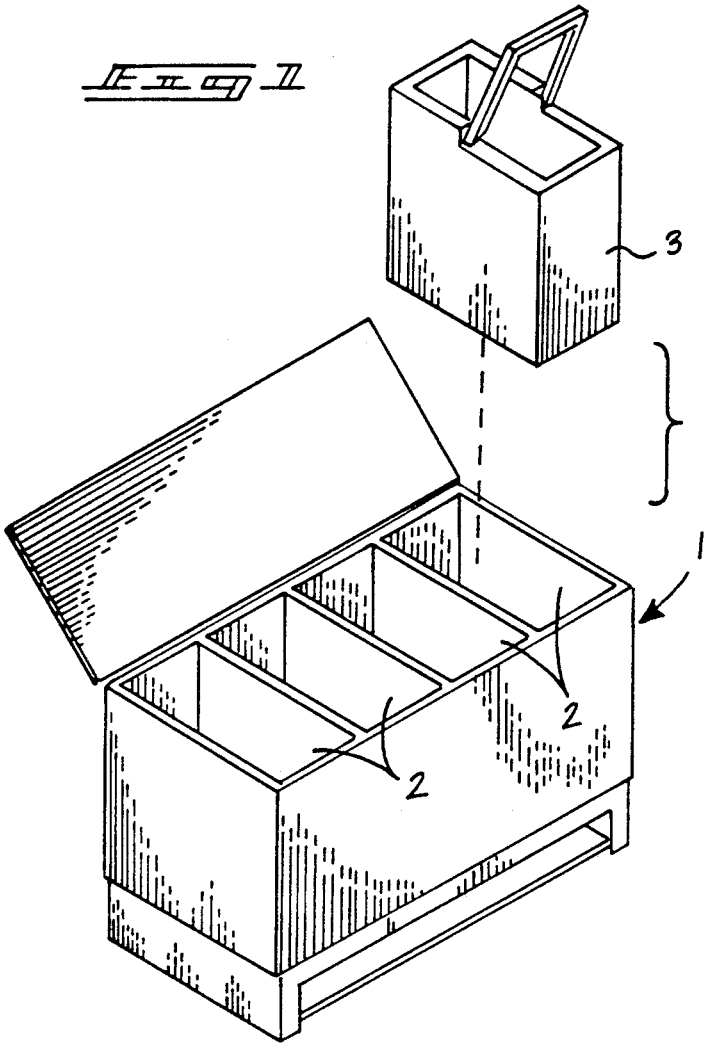
FIG. 1 is an isometric illustration of a prior art storage bin apparatus.

With reference now to the drawings, and in particular to FIGS. 1 to 8 thereof, a new and improved stackable recycling storage bin apparatus embodying the principles and concepts of the present invention and generally designated by the reference numeral 10 will be described.

Figure 2:
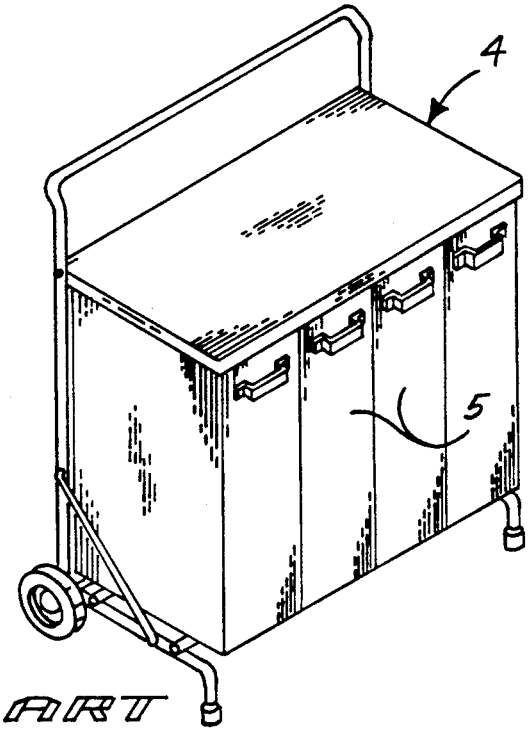
PRIOR ART Fig 2
FIG. 2 is an isometric illustration of a further example of a prior art storage bin apparatus.

FIG. 1 illustrates a prior art storage bin organization 1, wherein the bin includes a series of compartments 2, with each compartment including a removable container 3 that is removable from each compartment for removal of debris or recycling material from the bin. FIG. 2 illustrates a further prior art storage bin 4 of a similar construction, utilizing a single lid overlying a series of severed compartments 5 mounted on a platform, in a manner as set forth in U.S. Pat. No. 4,821,903. The organization in FIG. 1 is set forth in U.S. Pat. No. 4,801,034.

Figure 3:
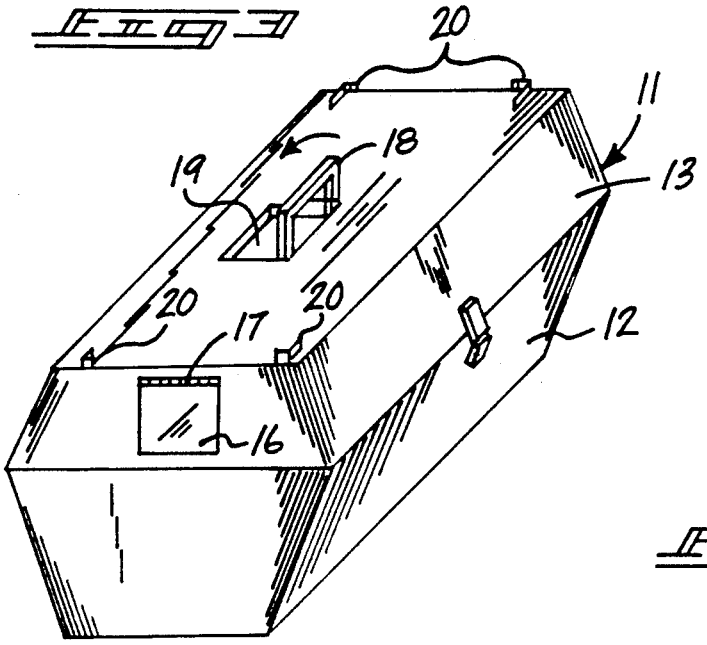
FIG. 3 is an isometric illustration of a single container and lid utilized by the instant invention.
Figure 4:
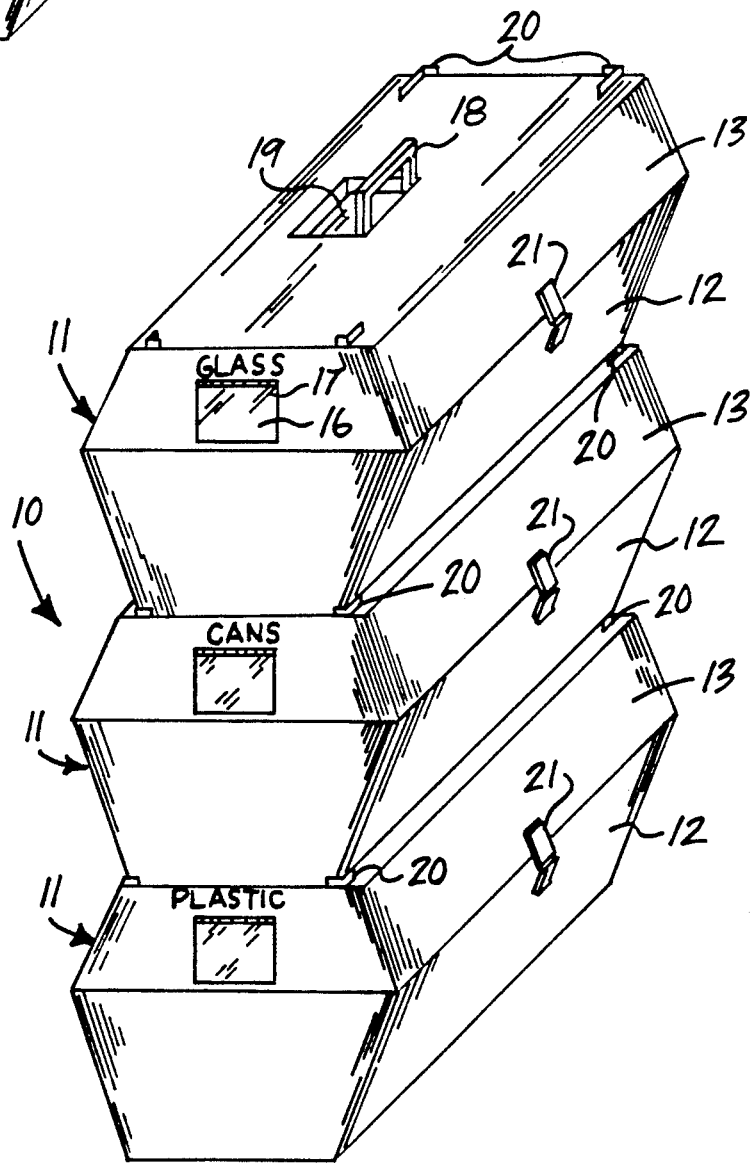
FIG. 4 is an isometric illustration of the instant invention.
Figure 5:
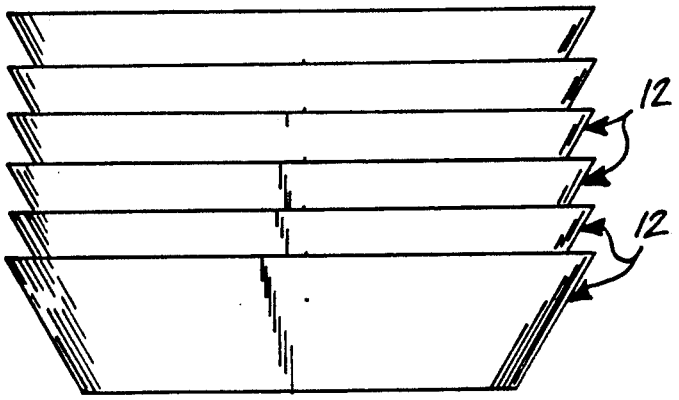
FIG. 5 is an isometric illustration of a plurality of containers in a nested arrangement for storage and transport thereof.
Figure 6:
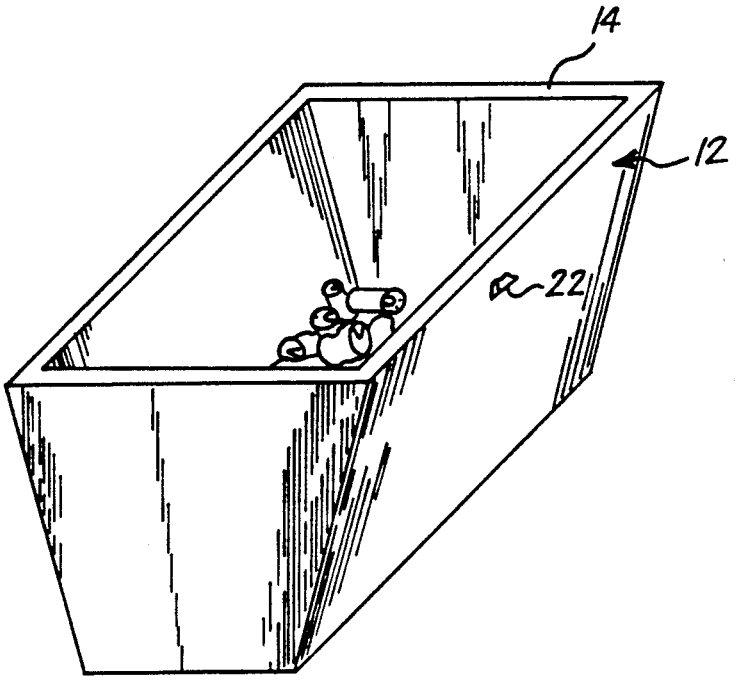
FIG. 6 is an isometric illustration of the container of the instant invention.

More specifically, the stackable recycling storage bin apparatus 10 of the instant invention essentially comprises series of storage bin members 11 that are arranged and securable in a vertically stacked orientation, as illustrated in FIG. 4. Each storage bin member 11 includes a storage container 12 defined by a first trapezoidal cross-sectional configuration. A lid member 13 is arranged for mounting to coextensively overlie the storage container 12 and is defined by a second trapezoidal cross-sectional configuration less than that of the first trapezoidal configuration to provide an organization, wherein the empty center of gravity is positioned within the storage container 12. The lower storage container 12 includes a continuous container upper edge 14 complementarily configured to receive a continuous lid lower edge 15. A pivotal door 16 is pivotally mounted through a forward end wall of the lid member 13 and utilizes a spring hinge 17 coextensive with an upper edge of the pivotal door 16 to bias the door in a vertical orientation. The lid member 13 further includes a "U" shaped handle 18 that is receivable within a handle cavity 19 of a generally rectangular parallelepiped configuration and defined by a depth substantially equal to a thickness defined by the handle 18. In this manner, the parallelepiped configuration permits the vertical stacking of the containers, as illustrated in FIG. 4, and further permits convenience of access to the handle 18 to position the handle 18 in a vertical orientation, as illustrated in FIG. 3 for example. Forward and rear pairs of "L" shaped lugs 20 are mounted to the forward and rear end edges of each lid that are spaced apart a predetermined spacing substantially equal to the predetermined width defined by the container floor of the storage container 12. The container floor is further defined by a floor length substantially equal to a lid length to thereby secure and position a floor of a container 12 onto an upper surface of each lid 11. A lid latch 21 is mounted to each side wall of each lid and cooperates with the container projection 22 to permit securement of each container and lid together and thereby permit ease of transport of each container to the desired collection point that will collect various components, such as glass, cans, plastic, and the like, utilized typically in recycling procedures.

FIG. 8 illustrates the use of an intermediate lid plate 23 defined by a generally rectangular configuration, and defines a predetermined surface area substantially equal to a predetermined area defined and encompassed by the upper and lower edges 14 and 15. In this manner, the plate 23 completely overlies the container 12 to accommodate and receive components of lesser volume and thereby minimize maintenance of the container in use. The lid plate 23 includes a flexible projecting tab 24 mounted fixedly to each corner of the plate 23 and directed upwardly thereof for reception within the lid member 13. The flexible nature of each projecting tab 24 permits flexing of each tab to align and position each tab within the sloping walls of the lid member 13.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stackable recycling storage bin apparatus comprising, in combination, a plurality of storage bin members, the storage bin members mounted in a vertical orientation relative to one another in a stacked vertical column, each storage bin member includes a lower storage container defined by a first trapezoidal cross-sectional configuration and defined by a predetermined length, and a lid member defined by the predetermined length and formed of a second trapezoidal configuration less than the first trapezoidal configuration to orient a center of gravity of an empty bin member within the container of each bin member, and each storage container including a continuous container upper edge complementarily configured to a continuous lid lower edge, and a pivotal door mounted within a forward wall of the lid member, the pivotal door including a spring hinge to bias the door in a vertical orientation in alignment with the forward wall of the lid member, and positioning means mounted fixedly to a top wall of the lid member to position and orient an overlying storage container thereon of the plurality of bin members.

2. An apparatus as set forth in claim 1 wherein the positioning means includes a first and second pair of "L" shaped lugs, with the first pair of "L" shaped lugs mounted in alignment with a forward edge of the lid member, and the second pair of "L" shaped lugs mounted to a rear edge of the lid member, and each pair of "L" shaped lugs spaced apart a predetermined spacing, and a floor defined by the container defined by a width equal to the predetermined spacing.

3. An apparatus as set forth in claim 2 wherein each lid member includes a "U" shaped handle mounted to the top wall of each lid member, and each lid member mounted within a parallelepiped cavity, wherein each parallelepiped cavity is defined by a predetermined depth and the handle is defined by a predetermined width, wherein the predetermined depth is equal to the predetermined width to permit reception of each handle within each cavity during stacking of the bin members.

4. An apparatus as set forth in claim 3 wherein each lid includes a plurality of side walls, and each side wall includes a latch member mounted thereon, each latch member cooperating with a container projection to secure the lid member to the container.

5. An apparatus as set forth in claim 4 wherein each bin member further includes an intermediate lid plate, the intermediate lid plate defined by a predetermined surface area, and the container upper edge and the lid lower edge each encompass an area equal to the predetermined surface area, and the lid plate formed of a rectangular configuration and includes a flexible projecting tab fixedly mounted to each corner of lid plate to permit deflection of each tab when the lid member is mounted to the container.

* * * * *